United States Patent [19]

Bert

[11] Patent Number: 4,987,655

[45] Date of Patent: Jan. 29, 1991

[54] END CONNECTOR FOR EXPANSIBLE WATCH BAND

[75] Inventor: Stephen F. Bert, North Scituate, R.I.

[73] Assignee: Textron, Inc., Providence, R.I.

[21] Appl. No.: 518,791

[22] Filed: May 4, 1990

[51] Int. Cl.[5] ..... A44C 5/18

[52] U.S. Cl. ..... 24/265 WS; 24/71 J

[58] Field of Search ..... 24/265 WS, 265 B, 70 J, 24/71 J, 629; 224/164, 173

[56] References Cited

U.S. PATENT DOCUMENTS

| | | | |
|---|---|---|---|
| 3,365,877 | 1/1968 | Altman | 224/173 |
| 4,375,713 | 3/1983 | Bert et al. | 24/265 WS |
| 4,805,271 | 2/1989 | Ripley | 24/71 J |
| 4,837,901 | 6/1989 | Bert | 24/265 WS |

FOREIGN PATENT DOCUMENTS

| | | | |
|---|---|---|---|
| 847777 | 9/1960 | United Kingdom | 24/265 WS |

*Primary Examiner*—Victor N. Sakran

*Attorney, Agent, or Firm*—Samuels, Gauthier & Stevens

[57] ABSTRACT

An end connector for connecting an end of an expansible watch band to a conventional spring bar or the like carried on a watch case. The end connector includes a planar base member having one end inserted into the end of the band in mechanical engagement with staples interconnecting the top and bottom links, and having its opposite end protruding beyond the end of the band and coupled to the spring bar. A cover overlies the protruding portion of the base member and the spring bar and is secured to the base member at a position interposed between the endmost top link and the watch case.

10 Claims, 4 Drawing Sheets

END CONNECTOR FOR EXPANSIBLE WATCH BAND

BACKGROUND OF THE INVENTION

1. Field of the Invention

This invention relates generally to expansible watch bands, and is concerned in particular with an improved end connector for connecting the ends of such bands to conventional spring bars or the like carried on watch cases.

2. Description of the Invention

The conventional expansible watch band typically includes a row of box like top links overlying a row of box like bottom links, with the links of one row being staggered in relation to those of the other row. The top and bottom links are interconnected by pairs of U-shaped staples, with the staples of each pair being located along opposite edges respectively of the band in a mutually confronting relationship. The staples have legs which protrude inwardly into the ends of the links to cooperate with internal springs in providing a means of accommodating longitudinal expansion and contraction of the band. Typically, the top links are covered with ornamental top shells.

My U.S. Pat. No. 4,837,901 discloses an end connector for such bands having a generally planar base member inserted between the endmost bottom and top links in an interlocked relationship with the interconnecting staples. A protruding outer end of the base member is coupled to a spring bar on the watch case. A cover overlies the spring bar, the protruding outer end of the base member coupled thereto, and the endmost top link, the latter being without a decorative top shell.

With this arrangement, the inner end of the cover overlying the endmost top link must be decoratively configured to duplicate the design of the band's decorative top shells. However, the outer end of the cover must be functionally configured to coactively engage with that portion of the base member coupled to the spring bar. These diverse decorative and functional requirements impose serious limitations on the extent to which the cover can be configured to accommodate and blend together with the design of the watch case. Thus, except for situations where the band and watch case are originally manufactured with matching designs, it becomes difficult if not impossible to achieve an integrated "custom" look when combining an existing band design with an existing watch case design.

My copending application Ser. No. 07/306,068 discloses another expansible watch band end connector employing an inserted interlocked generally planar base member coupled to a spring bar, but without an accompanying cover. Here again, unless the band and watch case are originally manufactured with the same ornamental design, an integrated custom look is most difficult to achieve.

A general objective of the present invention is to provide an improved end connector which obviates or at least significantly minimizes the above-described disadvantages associated with prior designs.

A more specific objective of the present invention is to provide an end connector which securely couples an end of an expansible watch band to a watch case, while also making it possible to accommodate the ornamental design of both the band's top shells and the watch case to thereby impart an integrated custom look to the resulting combination.

A companion objective of the present invention is to provide an end connector which may be mass produced and automatically assembled to the ends of expansible watch bands, thereby making it possible to realize significant savings in manufacturing costs.

These and other objects and advantages of the present invention will become more apparent as the description proceeds with the aid of the accompanying drawings, wherein:

DETAILED DESCRIPTION OF PREFERRED EMBODIMENT

Figure 1:
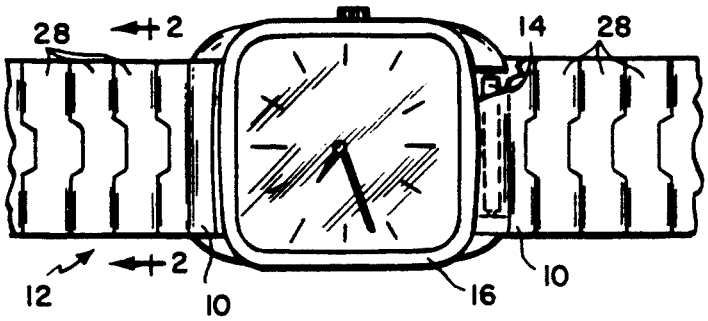
FIG. 1 is a top plan view of an expansible watch band connected to a watch case by means of end connectors of the present invention.

Referring initially to FIGS. 1–9, a pair of end connectors in accordance with the invention are generally depicted at 10. The end connectors provide a connection between the ends of an expansible watch band 12 and conventional spring bars 14 or the like carried on a watch case 16.

The expansible watch band 12 is of the conventional type having a row of box-like top links 18 overlying a row of boxlike bottom links 20. The links 18,20 are staggered in relation to each other in the direction of the band length, and are interconnected by pairs of U-shaped staples *22a,22b*. The staples of each pair are located along opposite edges respectively of the band, with legs 24 on the staples received in opposite ends of the links 18,20 connected thereby. The staple legs 24 coact with internal springs 26 in a known manner to accommodate resilient longitudinal expansion and contraction of the band 12. Typically, the top links 18 are covered by decorative top shells 28. Often, as in the case herein illustrated, the top shells have intricate ornamental shapes with interlocking side walls.

The watch case 16 may be of any conventional type, having mutually spaced lugs 30 with spring bars 14 or the like removably secured therebetween.

Figure 6:
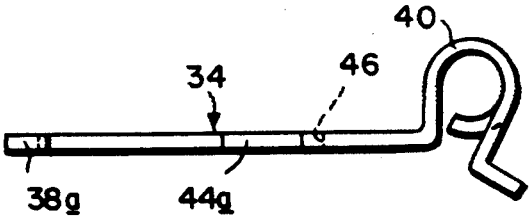
FIGS. 5, 6 and 7 are respectively top plan, side and end views of the base member comprising a part of the end connector of the present invention.
Figure 7:
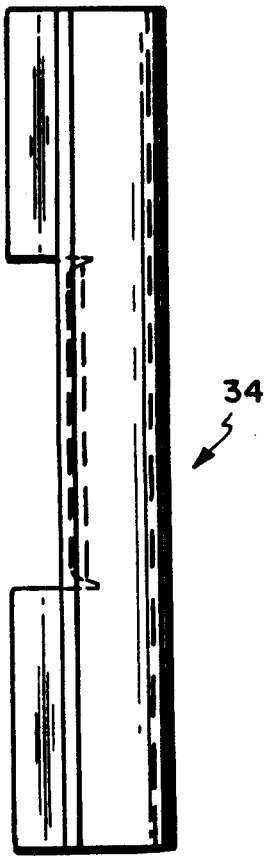
Figure 5:
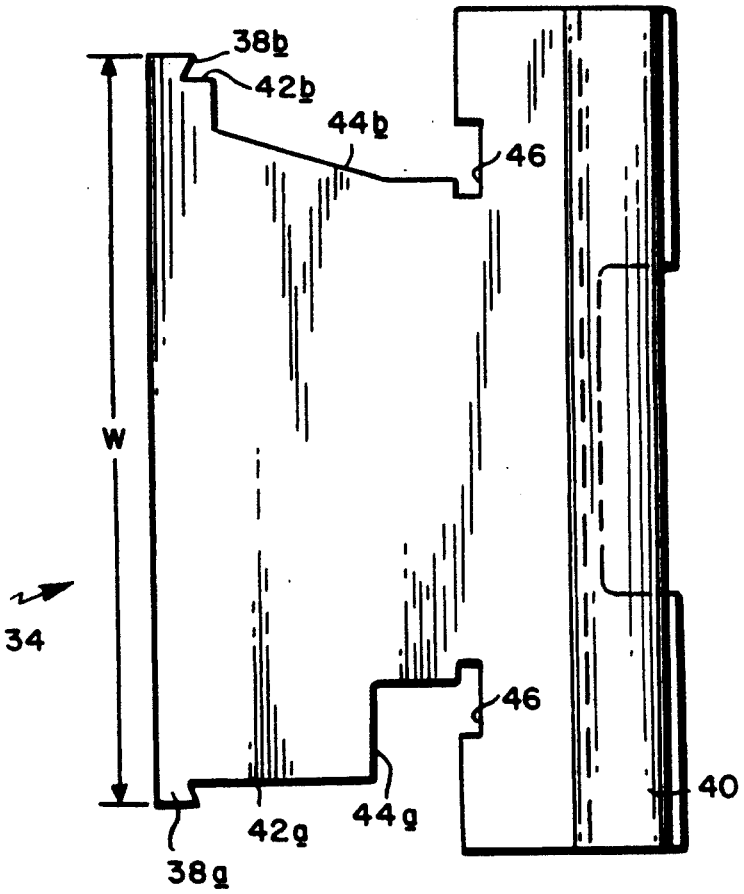

The end connector 10 includes a generally planar base member 34 which is shown in greater detail in FIGS. 5–7. The base member is provided at an inner end thereof with engagement means in the form of first and second ears *38a,38b* protruding laterally in opposite directions. A hook portion 40 is integrally formed at an outer end of the base member 34. The hook portion 40 is configured to at least partially surround and engage a spring bar 14.

The width "W" of the base member 34 measured at its inner end across ears 38a,38b is greater than the space "S" (see FIG. 11) between the staple pairs 22a,22b. The inner end of the base member is dimensioned for insertion into the end of the band between the top and bottom links 18,20, and the side edges 42a,42b are appropriately configured to accommodate manipulation of the thus inserted base member in its plane in directions required to locate the ears 38a,38b at interlocked positions inwardly of the innermost staples of the first and second pairs of staples 22a,22b at the end of the band.

In this connection, it will be seen that the side edges 42a,42b of the base member have contoured notches 44a,44b leading to recesses 46. Referring now to FIGS. 11–14, the sequence of planar manipulations required to insert the base member into interlocked engagement in the end of the band will now be described. Since FIGS. 11–14 depict the bottom of the band, the orientation of features will be reversed from that depicted for example in FIGS. 1–3.

Figure 11:
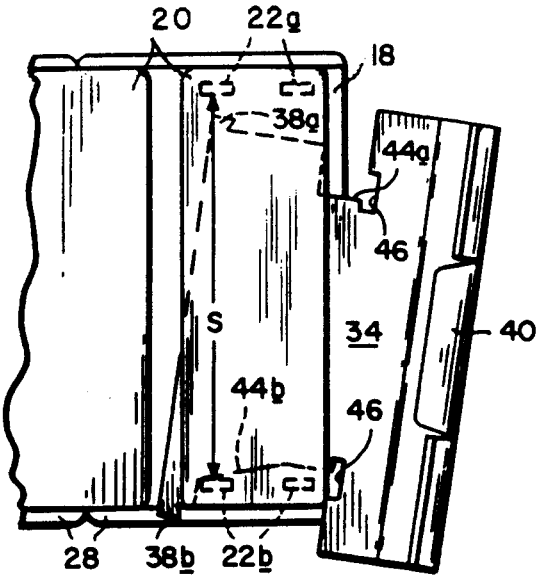
FIGS. 11–14 are bottom views depicting the sequential steps involved in inserting the base member into its interlocked position in the end of the band.

Beginning with FIG. 11, the base member 34 is inserted at an angle into the end of the band between the endmost top and bottom links 18,20. The staples 22b are temporarily received in contoured notch 44b, with ear 38b being spaced in the direction of the band length behind the innermost staple 22b, and with the ear 38a being located laterally inwardly of the innermost staple 22a.

Figure 12:
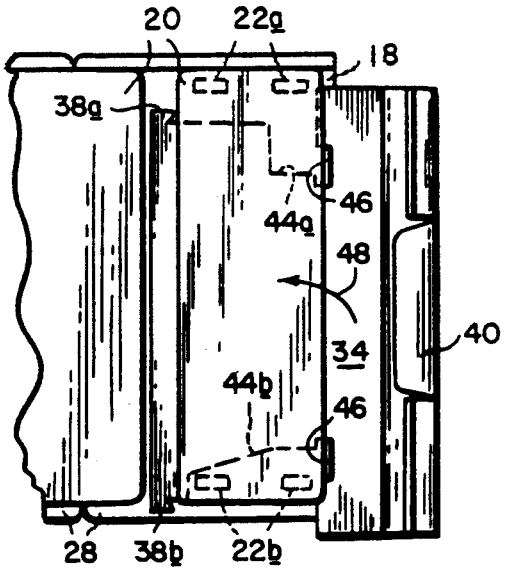
Figure 13:
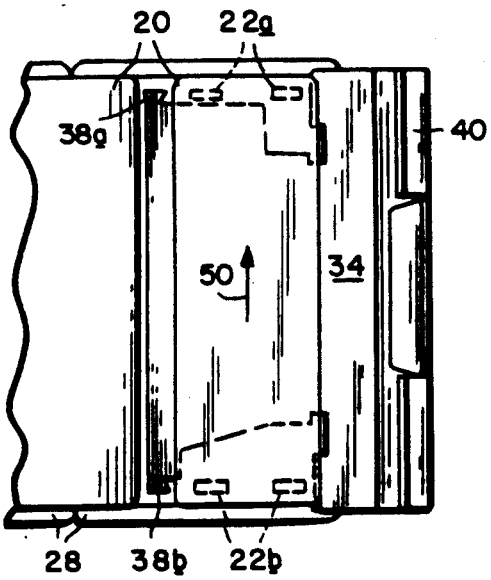

As shown in FIG. 12, the base member is next rotated in the direction of arrow 48 to swing ear 38a past the innermost staple 22a into lateral alignment with ear 38b. Next, as shown in FIG. 13, the base member is shifted in the direction of arrow 50 to locate the ears 38a,38b behind but spaced from the respective innermost staples 22a,22b.

Figure 14:
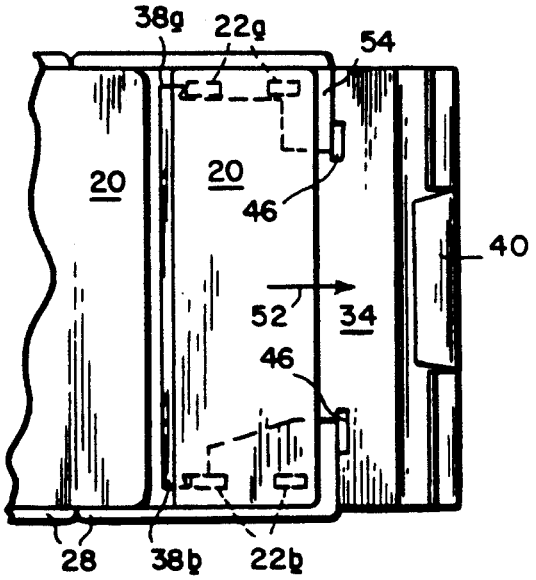

Finally, as shown in FIG. 14, the base member is pulled in the direction of arrow 52 to bring the ears 38a,38b into engagement with the respective innermost staples 22a,22b. When thus positioned, the inner end of the base member 34 is interlocked into the end of the band, the outer end of the base member including hook portion 40 protrudes beyond the end of the band, and the recesses 46 extend forwardly of the outboard edge 54 of the endmost top link 18.

Figure 10:
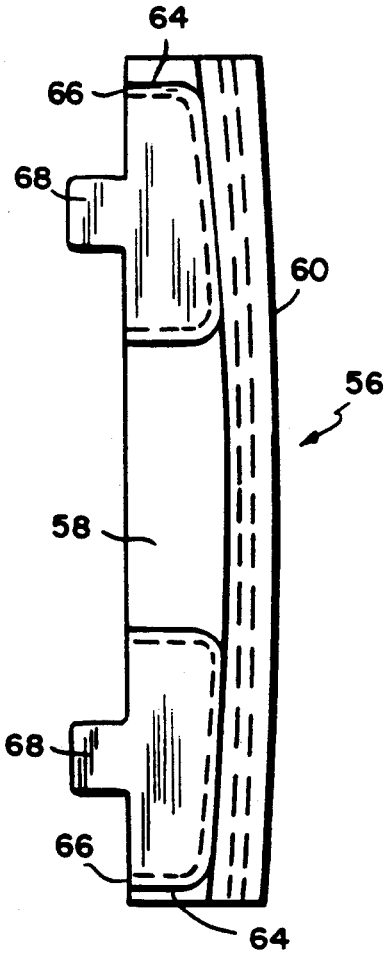
FIGS. 8, 9 and 10 are respectively top plan, side and end views of the cover member comprising a part of the end connector of the present invention.
Figure 8:
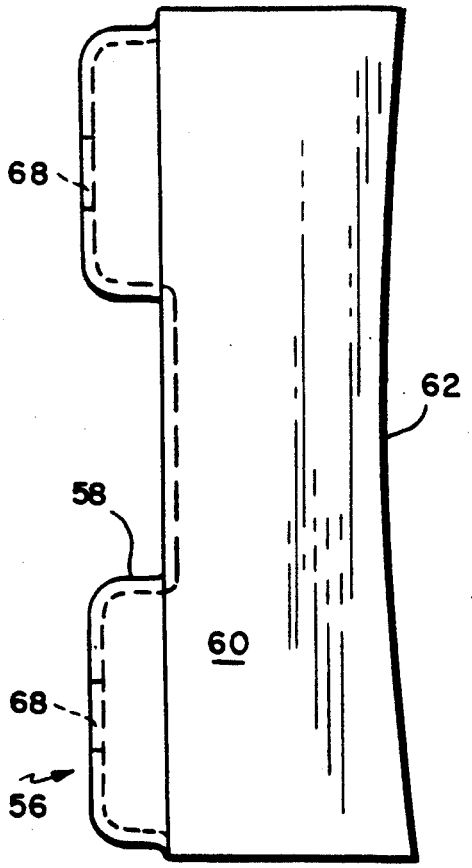
Figure 9:
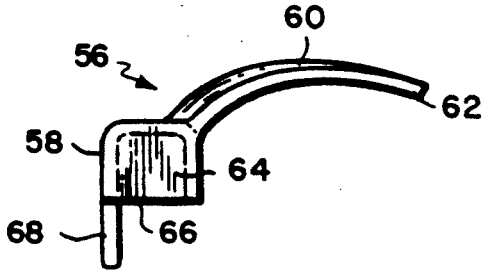

Referring now to FIGS. 8–10, it will be seen that the end connector of the present invention further includes a cover member generally depicted at 56. The cover member has an inner end wall 58 configured to mate with the contoured side wall of the endmost top shell 28. A curved top wall 60 extends in cantilever fashion from the end wall 58. The outer edge 62 of the top wall 60 shaped to mate with the shape and design of the watch case 16. Parallel side walls 64 extend forwardly from the end wall 58. The side walls 64 have flat bottom edges 66. Bendable tabs 68 protrude downwardly from the end wall 58.

Figure 3:
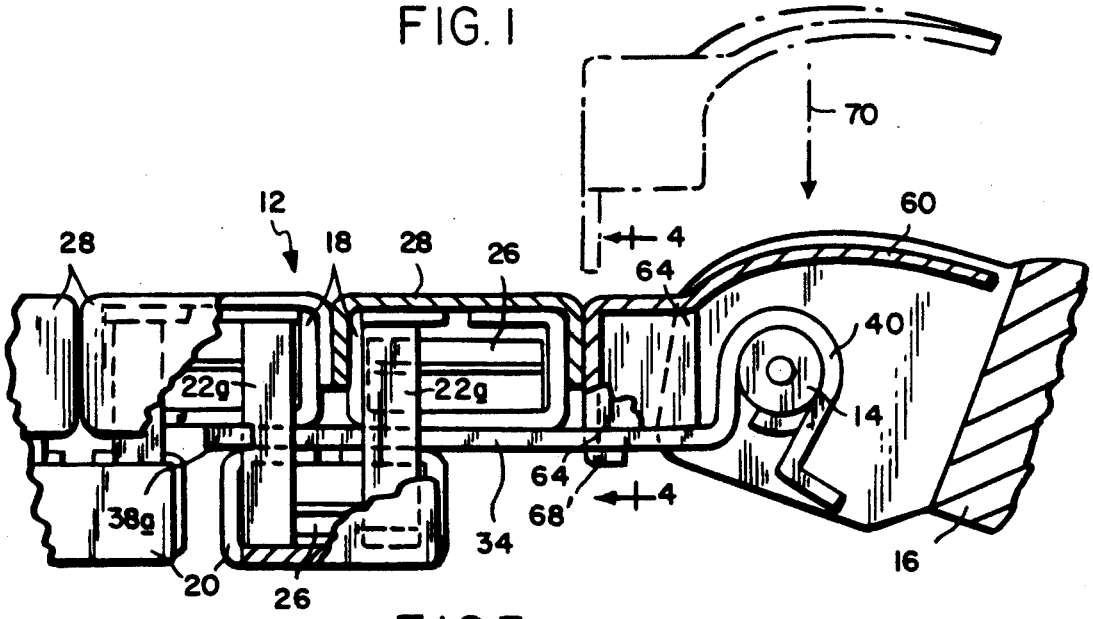
FIG. 3 is a longitudinal sectional view taken along line 3—3 of FIG. 2.
Figure 2:
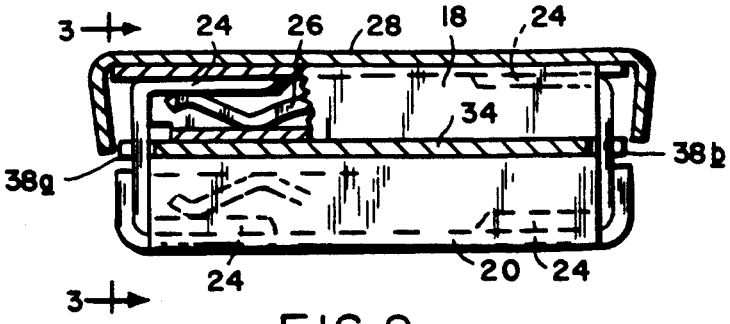
FIG. 2 is a cross sectional view on an enlarged scale taken along line 2—2 of FIG. 1.
Figure 4:
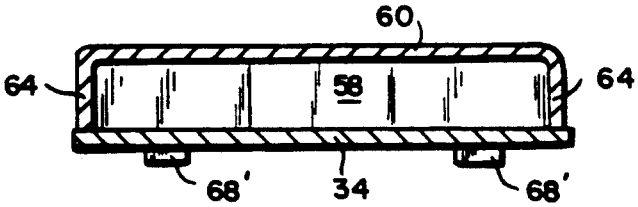
FIG. 4 is a sectional view taken along line 4—4 of FIG. 3.

After the base member 34 has been inserted into the end of the band in interlocked engagement with the innermost staples 22a,22b of the endmost staple pair, as previously described and as illustrated in FIG. 14, the cover member 56 is applied in the direction indicated by the arrow 70 in FIG. 3. The tabs 68 pass through the exposed recesses 46 in the base member and are then bent over as shown at 68' in FIGS. 3 and 4. The flat bottom edges 66 of the side walls 64 are thus pulled down firmly against the upper surface of the base member, thereby providing a secure base from which the curved top wall 60 extends in cantilever fashion towards the watch case 16.

In light of the foregoing, it will now be appreciated by those skilled in the art that the present invention offers a number of important advantages as compared with known prior art designs. Of particular importance is the design of the cover member 56 and the manner in which it is secured to the underlying base member 34. More particularly, the inner end of the cover member is decoratively shaped to mate with the endmost top shell of the band, in addition to also serving as a base for supporting the outer end defined by the cantilevered top wall 60. This leaves the designer free to shape the top wall to accommodate a wide range of diverse watch case designs. The bendable tabs 68, which are also located at the inner end of the cover, provide a means of securely and reliably mounting the cover member on the forwardly protruding section of the base member. When thus mounted, the cover member occupies substantially the entire space between the endmost top shell 28 and the watch case 16. Thus, shifting of the base member in a direction opposite to that indicated by the arrow 52 in FIG. 14 is effectively prevented, which in turn insures that the base member remains inserted in an interlocked arrangement within the end of the band.

The cover member has a relatively simple straightforward design which is ideally suited to mass production and automatic assembly. This translates into important savings in production costs.

I claim:

1. For use in combination with an elongated longitudinally expansible watch band of the type having a row of top links overlying a row of bottom links, each bottom link being connected to two adjacent top links by first and second pairs of generally U-shaped staples, said pairs of staples being separated from each other by a space measured in the direction of the band width and being arranged respectively along opposite sides of the band, said staples having legs protruding into the links connected thereby, with springs housed in the links and acting on said legs to yieldably contract the band longitudinally, a connector for connecting the band to a spring bar or the like carried on a watch case, said connector comprising:

a generally planar base member having inner and outer ends with first and second side edges extending therebetween, said inner end being configured and dimensioned for insertion into an end of the band between the rows of top and bottom links with said first and second side edges being respectively located laterally inwardly of the first and second pairs of staples at the said end of the band, and with an exposed section of said base member including said outer end protruding beyond the end most top link at the said end of the band; first engagement means at the outer end of said base member for coupling said base member to said spring bar;

first and second ears respectively protruding laterally from said first and second side edges at the inner end of said base member, said first and second ears being respectively located in the direction of the band length at interlocked positions inwardly of the innermost staples of the first and second pairs of staples at the end of said band, the width of said base member measured at said ears being greater than said space; and a cover member interposed between the end most top link at the said end of the band and the watch case at a location overlying the exposed section of said base member and the spring bar coupled thereto, said cover member including second engagement means for securing said cover member to said base member.

2. The connector of claim 1 wherein said side edges are contoured to accommodate manipulation of said base member in the plane of said base member between said first and second pairs of staples in order to locate said first and second ears at said interlocked positions.

3. The connector of claim 1 wherein said cover member has inner and outer ends respectively configured to mate with the adjacent contours of the end most top link at the said end of the band and the watch case.

4. The connector of claim 1 wherein said second engagement means comprises bendable tabs.

5. The connector of claim 4 wherein the exposed section of said base member is provided with means for receiving said tabs.

6. The connector of claim 1 wherein said cover member is provided with parallel side walls having flat bottom edges adapted to seat on the upper surface of the exposed section of said base member.

7. The connector of claim 1 wherein said cover member has an inner end located adjacent to the end most top link at the said end of the band and an outer end located adjacent to the watch case, said cover member including side walls at said inner end with flat bottom edges resting on the upper surface of the exposed section of said base member.

8. The connector of claim 7 wherein said second engagement means comprises bendable tabs received in apertures in the exposed section of said base member.

9. The connector of claim 8 wherein said bendable tabs extend through said apertures and engage the underside of the exposed section of said base member to hold the flat bottom edges of said side walls against the upper surface of the exposed section of said base member.

10. The connector of claim 7 wherein the outer end of said cover member extends in cantilever fashion from said inner end.

* * * * *